US005763800A

United States Patent [19]

Rossum et al.

[11] Patent Number: 5,763,800

[45] Date of Patent: Jun. 9, 1998

[54] METHOD AND APPARATUS FOR FORMATTING DIGITAL AUDIO DATA

[75] Inventors: David P. Rossum, Aptos; Michael Guzewicz, San Jose; Robert S. Crawford; Matthew F. Williams, both of Santa Cruz; Donald F. Ruffcorn, Los Gatos, all of Calif.

[73] Assignee: Creative Labs, Inc., Milpitas, Calif.

[21] Appl. No.: 514,788

[22] Filed: Aug. 14, 1995

[51] Int. Cl.[6] ..... G10H 1/02; G10H 7/00

[52] U.S. Cl. ..... 84/603; 84/622; 84/626; 84/659; 84/662

[58] Field of Search ..... 84/602–607, 618, 84/619, 622–629, 645, 659–663

[56] References Cited

U.S. PATENT DOCUMENTS

| | | | |
|---|---|---|---|
| 4,483,231 | 11/1984 | Hirano | 84/1.19 |
| 4,893,538 | 1/1990 | Masaki et al. | 84/605 |
| 5,020,410 | 6/1991 | Sasaki | 84/602 |
| 5,243,124 | 9/1993 | Kondratiuk et al. | 84/624 |
| 5,444,818 | 8/1995 | Lisle | 395/2.67 |
| 5,536,358 | 7/1996 | Zimmerman | 84/477 R |

*Primary Examiner*—Jonathan Wysocki
*Assistant Examiner*—Marlon T. Fletcher
*Attorney, Agent, or Firm*—Townsend and Townsend and Crew LLP

[57] ABSTRACT

An audio data format in which an instrument is described using a combination of sound samples and articulation instructions which determine modifications made to the sound sample is provided. The instruments form a first, initial layer, with a second layer having presets which can user defined to provide additional articulation instructions which can modify the articulation instructions at the instrument level. The articulation instructions are specified using various parameters. The present invention provides a format in which all of the parameters are specified in units which relate to a physical phenomena, and thus are not tied to any particular machine for creating or playing the audio samples. The articulation parameters include generators and modulators, which provide a connection between a real-time signal and a generator. The parameter units are specified in perceptually additive units, to make the data portable and easily edited. New units are defined to give perceptual additive parameters throughout.

36 Claims, 8 Drawing Sheets

| |
|---|
| "RIFF" <size> "sfbk" |
| "LIST" <size> "INFO" |
| "ifil" <size> <format version> |
| "isng" <size> "<target sound engine" |
| "INAM" <size> "<bank name>" |
| ["irom" <size> "<ROM name>"] |
| ["iver" <size> "<ROM version>"] |
| ["ICRD" <size> "<creation date>"] |
| ["IENG" <size> "<names of engineers and sound designers>"] |
| ["IPRD" <size> "<target product>"] |
| ["ICOP" <size> "<copyright string>"] |
| ["ICMT" <size> "<comment string>"] |
| [optional future INFO chunk sub-chunks] |
| "LIST" <size> "sdta" |
| ["smpl" <size> <digital audio data>] |
| "LIST" <size> "pdta" |
| "phdr" <size> <preset headers> |
| "pbag" <size> <preset layer indicies> |
| "pmod" <size> <preset layer modulators> |
| "pgen" <size> <preset layer generators> |
| "inst" <size> <instrument headers> |
| "ibag" <size> <instrument split indicies> |
| "imod" <size> <instrument split modulators> |
| "igen" <size> <instrument split generators> |
| "shdr" <size> <sample headers> |

*FIG. 9*

METHOD AND APPARATUS FOR FORMATTING DIGITAL AUDIO DATA

BACKGROUND OF THE INVENTION

The present invention relates to the use of digital audio data, in particular a format for storing sample-based musical sound data.

The electronic music synthesizer was invented simultaneously by a number of individuals in the early 1960's, most notably Robert Moog and Donald Buchla. The synthesizers of the 1960's and 1970's were primarily analog, although by the late 70's computer control was becoming popular.

With the advances in consumer electronics made possible by VLSI and digital signal processing (DSP), it became practical in the early 1980's to replace the fixed single cycle waveforms used in the sound producing oscillators of synthesizers with digitized waveforms. This development forked into two paths. The professional music community followed the line of "sample based music synthesizers," notably the Emulator line from E-mu Systems. These instruments contained large memories which reproduced an entire recording of a natural sound, transposed over the keyboard range and appropriately modulated by envelopes, filters and amplifiers. The low cost personal computer community instead followed the "wavetable" approach, using tiny memories and creating timbre changes on synthetic or computed sound by dynamically altering the stored waveform.

During the 1980's, another relatively low cost music synthesis technique using frequency modulation (FM) became popular first with the professional music community, later transferring to the PC. While FM was a low cost and highly versatile technology, it could not match the realism of sample based synthesis, and ultimately it was displaced by sample based approaches in professional studios.

During the same time frame, the Musical Instrument Digital Interface (MIDI) standard was devised and accepted throughout the professional music community as a standard for the realtime control of musical instrument performances. MIDI has since become a standard in the PC multimedia industry as well.

The professional sample based synthesizers expanded in their capabilities in the early 1990's, to include still more DSP. The declining cost of memory brought to the wavetable approach the ability to use sampled sounds, and soon wavetable technology and sample sound synthesis became synonymous. In the mid '90s wavetable synthesis became inexpensive enough to incorporate in mass market products. These wavetable synthesizer chips allow very good quality music synthesis at popular prices, and are currently available from a variety of vendors. While many of these chips operate from samples or wave tables stored in read only memory (ROM), a few allow the downloading of arbitrary samples into RAM memory.

The Musical Instrument Digital Interface (MIDI) language has become a standard in the PC industry for the representation of musical scores. MIDI allows for each line of a musical score to control a different instrument, called a preset. The General MIDI extension of the MIDI standard establishes a set of 128 presets corresponding to a number of commonly used musical instruments.

While General MIDI provides composers with a fixed set of instruments, it neither guarantees the nature or quality of the sounds those instruments produce, nor does it provide any method of obtaining any further variety in the basic sounds available. Various musical instrument manufacturers have produced extensions of General MIDI to allow for more variations on the set of presets. It should be clear, however, that the ultimate flexibility can only be obtained by the use of downloadable digital audio files for the basic samples.

The General MIDI standard was an attempt to define the available instruments in a MIDI composition in such a way that composers could produce songs and have a reasonable expectation that the music would be acceptably reproduced on a variety of synthesis platforms. Clearly this was an ambitious goal; from the two operator FM synthesis chips of the early PC synthesizers, through sampled sound and "wavetable" synthesizers and even "physical modelling" synthesis, a tremendous variety of technology and capability is spanned.

When a musician presses a key on a MIDI musical instrument keyboard, a complex process is initiated. The key depression is simply encoded as a key number and "velocity" occurring at a particular instant in time. But there are a variety of other parameters which determine the nature of the sound produced. Each of the 16 possible MIDI "channels" or keyboard of sound is associated at any instant to a particular bank and preset, which determines the nature of the note to be played. Furthermore, each MIDI channel also has a variety of parameters in the form of MIDI "continuous controllers" that may alter the sound in some manner. The sound designer who authored the particular preset determined how all of these factors should influence the sound to be made.

Sound designers use a variety of techniques to produce interesting timbres for their presets. Different keys may trigger entirely different sequences of events, both in terms of the synthesis parameters and the samples which are played. Two particularly notable techniques are called layering and multi-sampling. Multi-sampling provides for the assignment of a variety of digital samples to different keys within the same preset. Using layering, a single key depression can cause multiple samples to be played.

In 1993, E-mu Systems realized the importance of establishing a single universal standard for downloadable sounds for sample based musical instruments. The sudden growth of the multimedia audio market had made such a standard necessary. E-mu devised the SoundFont® 1.0 audio format as a solution. (SoundFont® is a registered trademark of E-mu Systems, Inc.) The SoundFont® 1.0 audio format was originally introduced with the Creative Technology SoundBlaster AWE32 product using the EMU8000 synthesizer engine.

The SoundFont® audio format is designed to specifically address the concerns of wavetable (sampling) synthesis. The SoundFont® audio format differs from previous digital audio file formats in that they contain not only the digital audio data representing the musical instrument samples themselves, but also the synthesis information required to articulate this digital audio. A SoundFont® audio format bank represents a set of musical keyboards, each of which is associated with a MIDI preset. Each MIDI "preset" or keyboard of sound causes the digital audio playback of one or more appropriate samples contained within the SoundFont® audio format. When this sound is triggered by the MIDI key-on command, it is also appropriately controlled by the MIDI parameters of note number, velocity, and the applicable continuous controllers. Much of the uniqueness of the SoundFont® audio format rests in the manner in which this articulation data is handled.

The SoundFont® audio format is formatted using the "chuck" concepts of the standard Resource Interchange File Format (RIFF) used in the PC industry. Use of this standard format shell provides an easily understood hierarchical level to the SoundFont® audio format.

A SoundFont® audio format File contains a single SoundFont® audio format bank. A SoundFont® audio format bank comprises a collection of one or more MIDI presets, each with unique MIDI preset and bank numbers. SoundFont® audio format banks from two separate files can only be combined by appropriate software which must resolve preset identity conflicts. Because the MIDI bank number is included, a SoundFont® audio format bank can contain presets from many MIDI banks.

A SoundFont® audio format bank contains a number of information strings, including the SoundFont® audio format Revision Level to which the bank complies, the sound ROM, if any, to which the bank refers, the Creation Date, the Author, any Copyright Assertion, and a User Comment string.

Each MIDI preset within the SoundFont® audio format bank is assigned a unique name, a MIDI preset # and a MIDI bank #. A MIDI preset represents an assignment of sounds to keyboard keys; a MIDI Key-On event on any given MIDI Channel refers to one and only one MIDI preset, depending on the most recent MIDI preset change and MIDI bank change occurring in the MIDI channel in question.

Each MIDI preset in a SoundFont® audio format bank comprises an optional Global Preset Parameter List and one or more Preset Layers. The global preset parameter list contains any default values for the preset layer parameters. A preset layer contains the applicable key and velocity range for the preset layer, a list of preset layer parameters, and a reference to an Instrument.

Each instrument contains an optional global instrument parameter list and one or more instrument splits. A global instrument parameter list contains any default values for the instrument layer parameters. Each instrument split contains the applicable key and velocity range for the instrument split, an instrument split parameter list and a reference to a sample. The instrument split parameter list, plus any default values, contains the absolute values of the parameters describing the articulation of the notes.

Each sample contains sample parameters relevant to the playback of the sample data and a pointer to the sample data itself.

SUMMARY OF THE INVENTION

The present invention provides an audio data format in which an instrument is described using a combination of sound samples and articulation instructions which determine modifications made to the sound sample. The instruments form a first, initial layer, with a second layer having presets which can be user-defined to provide additional articulation instructions which can modify the articulation instructions at the instrument level. The articulation instructions are specified using various parameters. The present invention provides a format in which all of the parameters are specified in units which relate to a physical phenomena, and thus are not tied to any particular machine for creating or playing the audio samples.

Preferably, the articulation instructions include generators and modulators. The generators are articulation parameters, while the modulators provide a connection between a real-time signal (i.e., a user input code) and a generator. Both generators and modulators are types of parameters.

An additional aspect of the present invention is that the parameter units are perceptually additive. This means that when an amount specified in perceptually additive units is added to two different values of the parameter, the effect on the underlying physical value will be proportionate. In particular, percentages or logarithmically related units often have this characteristic. Certain new units are created to accommodate this, such as "time cents" which is a logarithmic measure of time used as a parameter unit herein.

The use of parameter units which are related to a physical phenomena and unrelated to a particular machine make the audio data format portable, so that it can be transferred from machine to machine and used by different people without modification. The perceptually additive nature of the parameter units allows simplified editing or modification of the timbres in an underlying music score expressed in such parameter units. Thus, the need to individually adjust particular instrument settings is eliminated, with the ability to make global adjustments at the preset level.

The modulators of the present invention are specified with four enumerators, including an enumerator which acts to transform the real-time source in order to map it into a perceptually additive format. Each modulator is specified using (1) a generator enumerator identifying the generator to which it applies, (2) an enumerator identifying the source used to modify the generator, (3) the transform enumerator for modifying the source to put it into perceptually additive form, (4) an amount indicating the degree to which the modulator will affect the generator, and (5) a source amount enumerator indicating how much of a second source will modulate the amount.

The present invention also insures that the pitch information for the audio samples is portable and editable by storing not only the original sample rate, but also the original key used in creating the sample, along with any original tuning correction.

The present invention also provides a format which includes a tag in a stereo audio sample which points to its mate. This allows editing without requiring a reference to the instrument in which the sample is used.

For a further understanding of the objects and advantages of the invention, reference should be made to the ensuing description taken in conjunction with the accompanying drawings.

BRIEF DESCRIPTION OF THE DRAWINGS

FIG. 9 is a diagram of the file format image according to the present invention;

DESCRIPTION OF THE PREFERRED EMBODIMENT

Synthesizers and Computers

Figure 1:
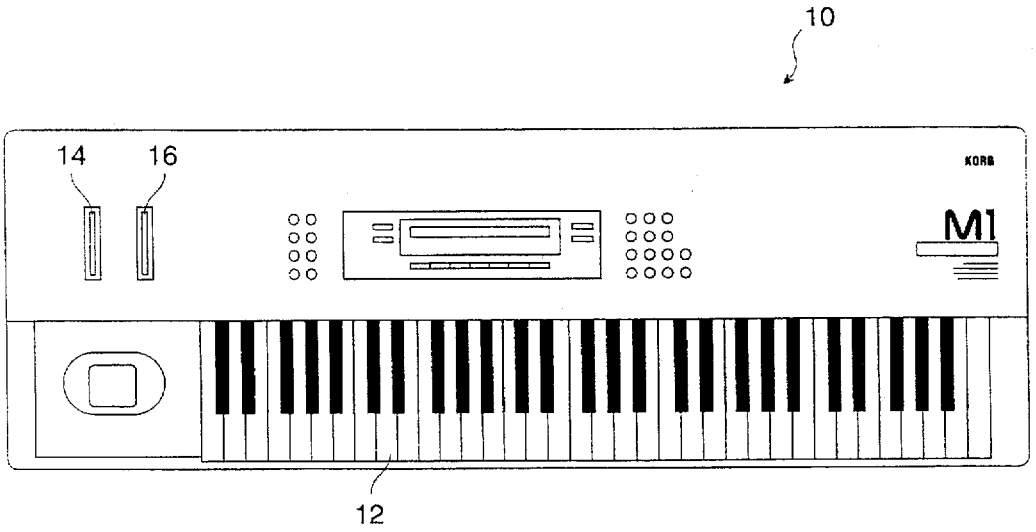
FIG. 1 is a drawing of a music synthesizer incorporating the present invention.

FIG. 1 illustrates a typical music synthesizer 10 which would incorporate an audio data structure according to the present invention in its memory. The synthesizer includes a number of keys 12, each of which can be assigned, for instance, to a different note of a particular instrument represented by a sound sample in the data memory. A stored note can be modified in real-time by, for instance, how hard the key is pressed and how long it is held down. Other inputs also provide modulation data, such as modulation wheels 14 and 16, which may modulate the notes.

Figure 2A:
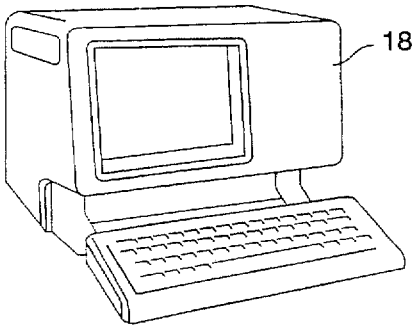
FIGS. 2A an 2B are drawings of a personal computer and memory disk incorporating the present invention.
Figure 2B:
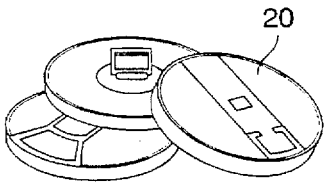

FIG. 2A illustrates a personal computer 18 which can have an internal soundboard. A memory disk 20, shown in FIG. 2B, incorporates audio data samples according to the present invention, which can be loaded into computer 18. Either computer 18 or synthesizer 10 could be used to create sound samples, edit them, play them, or any combination.

Basic Elements of Audio Sample, Modifiers

Figure 3:
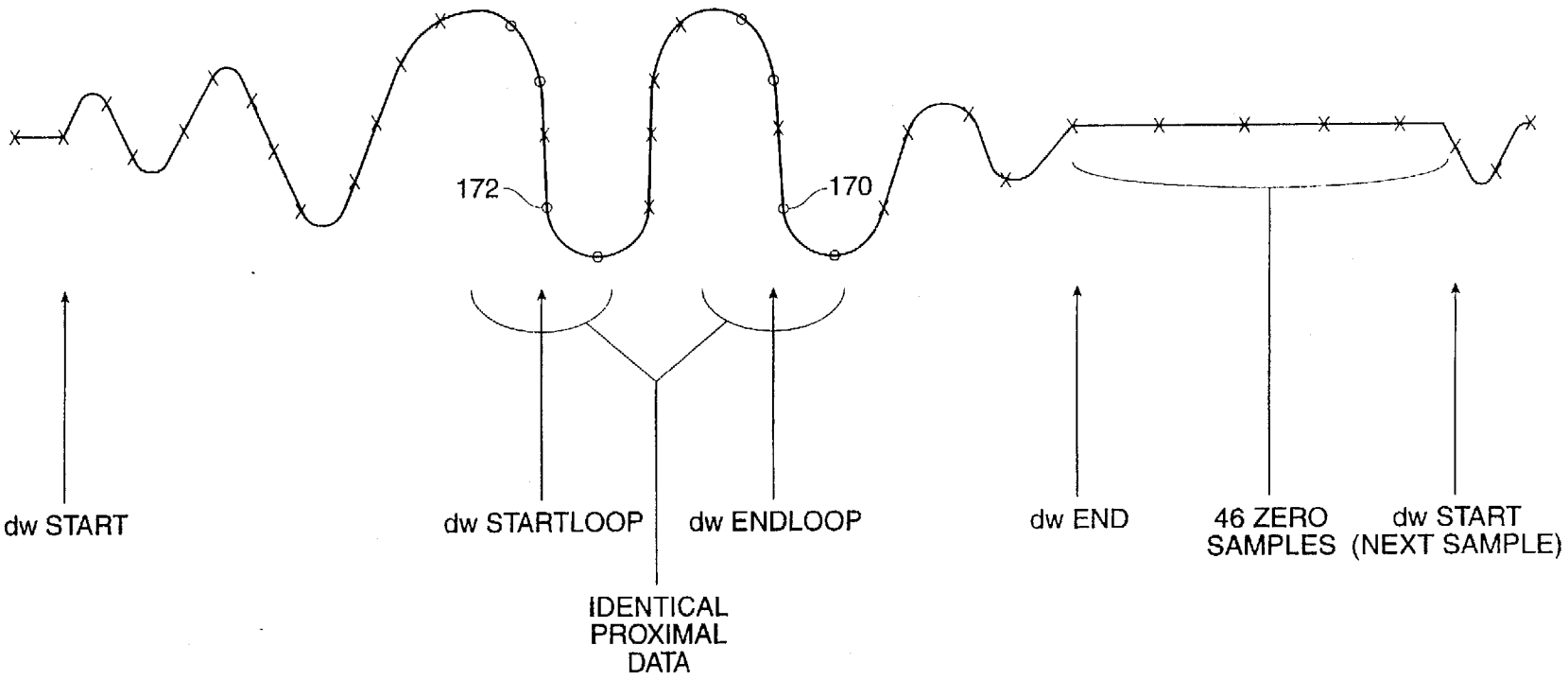
FIG. 3 is a diagram of an audio sample structure.
Figure 4A:
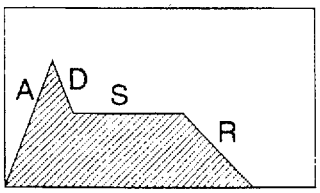
FIGS. 4A and 4B are diagrams illustrating different portions of an audio sample.
Figure 4B:
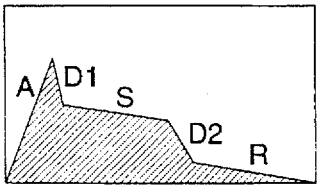

FIG. 3 is a diagram of the structure of a typical audio sample in memory. Such an audio sample can be created by recording an actual sound, and storing it in digitized format, or synthesizing a sound by generating the digital representation directly under the control of a computer program. An understanding of some of the basic aspects of the audio sample and how it can be articulated using generators and modulators is helpful in understanding the present invention. An audio sample has certain commonly accepted characteristics which are used to identify aspects of the sample which can be separately modified. Basically, a sound sample includes both amplitude and pitch. The amplitude is the loudness of the sounds, while the pitch is the wavelength or frequency. An audio sample can have an envelope for both the amplitude and for the pitch. Examples of some typical envelopes are shown in FIGS. 4A and 4B. The four aspects of the envelopes are defined as follows:

Attack. This is the time taken for the sound to reach its peak value. It is measured as a rate of change, so a sound can have a slow or a fast attack.

Decay. This indicates the rate at which a sound loses amplitude after the attack. Decay is also measured as a rate of change, so a sound can have a fast or slow decay.

Sustain. The Sustain level is the level of amplitude to which the sound falls after decaying. The Sustain time is the amount of time spent by the sound at the Sustain level.

Release. This is time taken by the sound to die out. It is measured as a rate of change, so a sound can have a fast or slow release.

The above measurements are usually referred to as ADSR (Attack, Decay, Sustain, Release) and a sound envelope is sometimes called an ADSR envelope.

Figure 5:
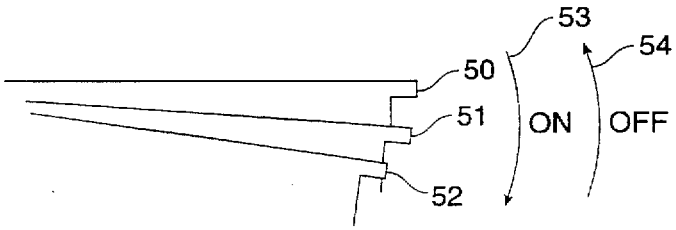
FIG. 5 is a diagram of a key illustrating different key input characteristics.

The way a key is pressed can modify the note represented by the key. FIG. 5 illustrates a key in three different positions, resting position 50, initial strike position 51 and after touch position 52.

Most keyboards have velocity-sensitive keys. The strike velocity is measured as a key is pressed from position 50 to position 51, as indicated by arrow 53. This information is converted into a number between 0 and 127 which is sent to the computer after the Note On MIDI message. In this way, the dynamic is recorded with the note (or used to modify note playback). Without this feature, all notes are reproduced at the same dynamic level.

Aftertouch is the amount of pressure exerted on a key after the initial strike. Electronic aftertouch sensors, if the keyboard is equipped with them, can sense changes in pressure after the initial strike of the key between position 51 and 52. For instance, alternating between an increase and a decrease in pressure can produce a vibrato effect. But MIDI aftertouch messages can be set to control any number of parameters, from portamento and tremolo, to those which completely change the texture of the sound. Arrow 54 indicates the release of the key which can be fast or slow.

Figure 6:
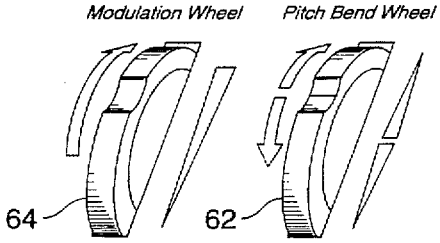
FIG. 6 is a diagram of a modulation wheel and pitch bend wheel as illustrative modulation inputs.

A pitch bend wheel 62 of FIG. 6 on a synthesizer is a very useful feature. By turning the wheel while holding down a key, the pitch of a note can be bent upwards or downwards depending on how far the wheel is turned and at what speed. Bending can be chromatic, that is to say in distinguishable semitone steps, or as a continuous glide.

A modulation control wheel 64 usually sends vibrato or tremolo information. It may be used in the form of a wheel or a joystick, though the terms "modulation wheel" is often used generically to indicate modulation.

An "LFO" is often referred to in music generation, and is a basic building block. The word "frequency" as represented in the acronym LFO (Low Frequency Oscillator) is not used to indicate pitch directly, but the speed of oscillation. An LFO is often used to act on an entire voice or an entire instrument, and it affects pitch and/or amplitude by being set to a certain speed and depth of variation, as is required in tremolo (amplitude) and vibrato (pitch).

SoundFont® Audio Format Characteristics

A SoundFont® audio format is a format of data which includes both digital audio samples and articulation instructions to a wavetable synthesizer. The digital audio samples determine what sound is being played; the articulation instructions determine what modifications are made to that data, and how these modifications are affected by the musician's performance. For example, the digital audio data might be a recording of a trumpet. The articulation data would include how to loop this data to extend the recording on a sustained note, the degree of artificial attack envelope to be applied to the amplitude, how to transpose this data in pitch as different notes were played, how to change the loudness and filtering of the sound in response to the "velocity" of a keyboard key depression, and how to respond to the musician's continuous controllers (e.g., modulation wheel) with vibrato or other modifications to the sound.

All wavetable synthesizers need some way to store this data. All wavetable synthesizers which allow the user to save and exchange sounds and articulation data need some form of file format in which to arrange this data. However, the 2.0 revision SoundFont® audio format is unique in three specific ways: it applied a variety of techniques to allow the format to be platform independent, it is easily editable, and it is upwardly and downwardly compatible with future improvements.

The SoundFont® audio format is an interchange format. It would typically be used on a CD ROM, disk, or other interchange format for moving the underlying data from one computer or synthesizer to another, for instance. Once in a particular computer, synthesizer, or other audio processing device, it may typically be converted into a format that is not a SoundFont® audio format for access by an application program which actually plays and articulates the data or otherwise manipulates it.

Figure 7:
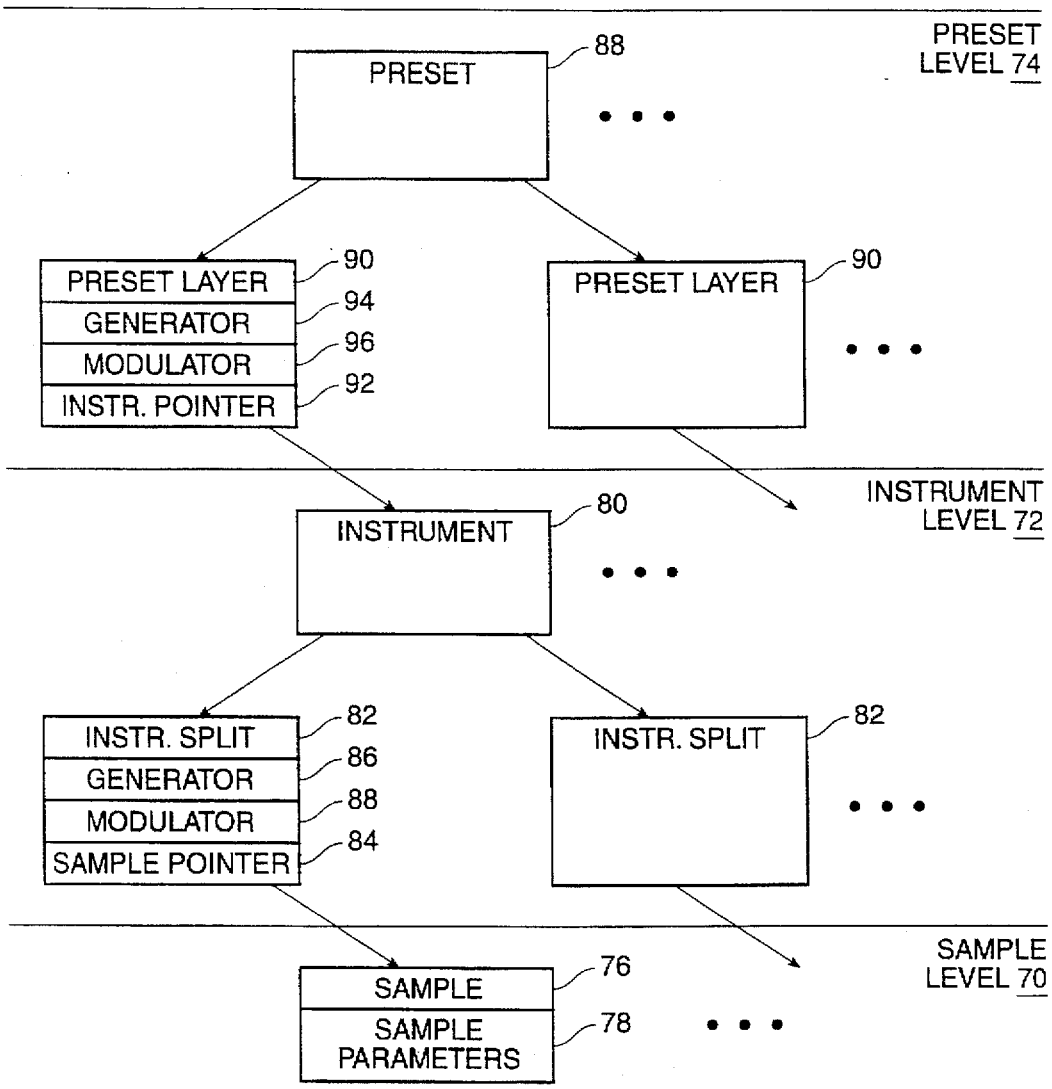
FIG. 7 is a block diagram of the instrument level and preset level incorporating the present invention.

FIG. 7 is a diagram showing the hierarchy of the SoundFont® audio format of the present invention. Three levels are shown, a sample level 70, an instrument level 72 and a preset level 74. Sample level 70 contains a plurality of samples 76, each with its corresponding sample parameters 78. At the instrument level, each of a plurality of instruments 80 contains at least one instrument split 82. Each instrument split contains a pointer 84 to a sample, along with, if applicable, corresponding generators 86 and modulators 88. Multiple instruments could point to the same sample, if desired.

At the preset level, a plurality of presets 88 each contain at least one preset layer 90. Each preset layer 90 contains an instrument pointer 92, along with associated generators 94 and modulators 96.

A generator is an articulation parameter, while a modulator is a connection between a real-time signal and a generator. The sample parameters carry additional information useful for editing the sample.

Generators

A generator is a single articulation parameter with a fixed value. For example, the attack time of the volume envelope is a generator, whose absolute value might be 1.0 seconds.

While the list of SoundFont® audio format generators is arbitrarily expandable, a basic list follows. Appendix II contains a list and brief description of the revision 2.0 SoundFont® audio format generators. The basic pitch, filter cutoff and resonance, and attenuation of the sound can be controlled. Two envelopes, one dedicated to control of volume and one for control of pitch and/or filter cutoff are provided. These envelopes have the traditional attack, decay, sustain, and release phases, plus a delay phase prior to attack and a hold phase between attack and decay. Two LFOs, one dedicated to vibrato and one for additional vibrato, filter modulation, or tremolo are provided. The LFOs can be programmed for depth of modulation, frequency, and delay from key depression to start. Finally, the left/right pan of the signal, plus the degree to which it is sent to the chorus and reverberation processors is defined.

Five kinds of generator Enumerators exist: Index Generators, Range Generators, Substitution Generators, Sample Generators, and Value Generators.

An index generator's amount is an index into another data structure. The only two index generators are instrument and sampleID.

A range generator defines a range of note-on parameters outside of which the layer or split is undefined. Two range generators are currently defined, keyRange and kelRange.

Substitution generators are generators which substitute a value for a note-on parameter. Two substitution generators are currently defined, overridingKeyNumber and overridingVelocity.

Sample generators are generators which directly affect a sample's properties. These generators are undefined at the layer level. The currently defined sample generators are the eight address offset generators and the sampleModes generator.

Value generators are generators whose value directly affects a signal processing parameter. Most generators are value generators.

Modulators

An important aspect of realistic music synthesis is the ability to modulate instrument characteristics in real time. This can be done in two fundamentally different ways. First, signal sources within the synthesis engine itself, such as low frequency oscillators (LFOs) and envelope generators can modulate the synthesis parameters such as pitch, timbre, and loudness. But also, the performer can explicitly modulate these sources, usually by means of MIDI Continuous Controllers (Ccs).

The revision 2.0 SoundFont® audio format provides tremendous flexibility in the selection and routing of modulation by the use of the modulation parameters. A modulator expresses a connection between a real-time signal and a generator. For example, sample pitch is a generator. A connection from a MIDI pitch wheel real-time bipolar continuous controller to sample pitch at one octave full scale would be a typical modulator. Each modulation parameter specifies a modulation signal source, for example a particular MIDI continuous controller, and a modulation destination, for example a particular SoundFont® audio format generator such as filter cutoff frequency. The specified modulation amount determines to what degree (and with what polarity) the source modulates the destination. An optional modulation transform can non-linearly alter the curve or taper of the source, providing additional flexibility. Finally, a second source (amount source) can be optionally specified to be multiplied by the amount. Note that if the second source enumerator specifies a source which is logically fixed at unity, the amount simply controls the degree of modulation.

Figure 11:
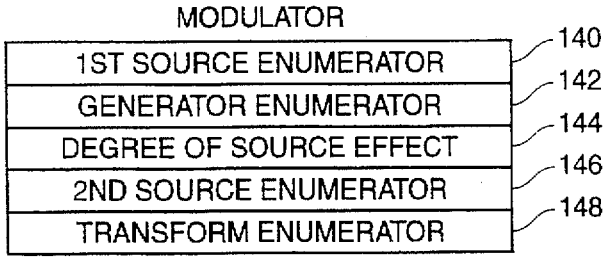
FIG. 11 is a diagram of the modulator format.
Figure 13:
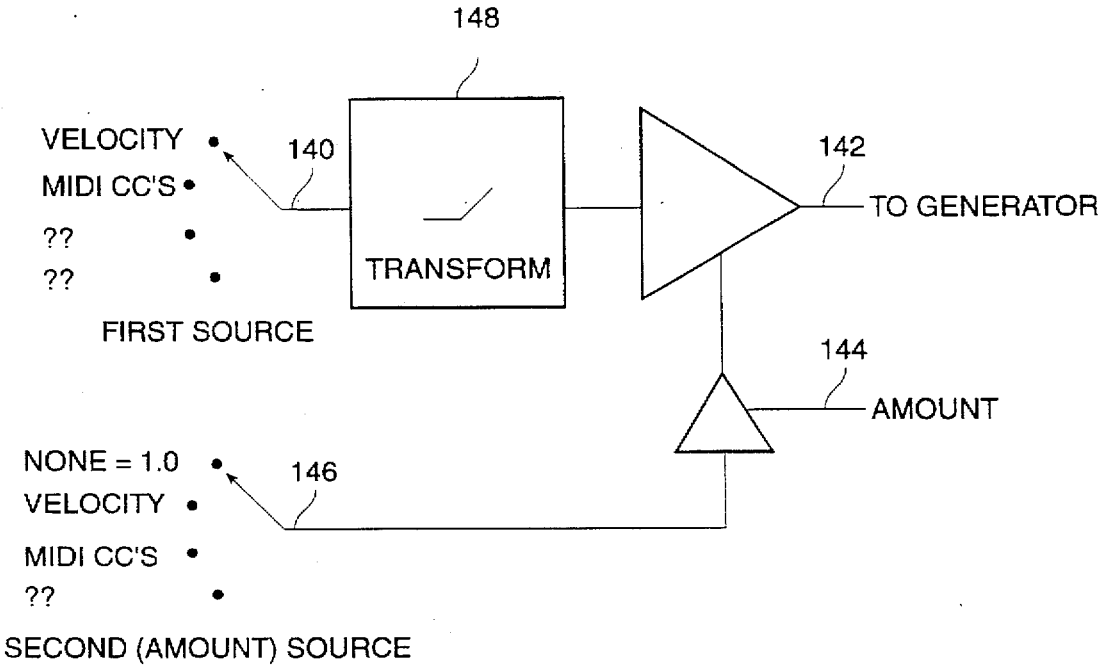
FIG. 13 is a diagram illustrating the relationship of the modulator enumerators and the modulator amount.

Modulators are specified using five numbers, as illustrated in FIG. 11. The relationships between these numbers are illustrated in FIG. 13. The first number is an enumerator 140 which specifies the source and format of the real-time information associated with the modulator. The second number is an enumerator 142 specifying the generator parameter affected by the modulator. The third number is a second source (amount source) enumerator 146, but this specifies that this source varies the amount that the first source affects the generator. The fourth number 144 specifies the degree to which the second source affects the first source 140. The fifth number is an enumerator 148 specifying a transformation operation on the first source.

The revision 1.0 SoundFont® audio format used enumerators for the generators only. As new generators and modulators are established and implemented, software not implementing these new features will not recognize their enumerators. If the software is designed to simply ignore unknown enumerators, bidirectional compatibility is achieved.

By using the modulator scheme extremely complex modulation engines can be specified, such as those used in the most advanced sampled sound synthesizers. In the initial implementation of revision 2.0 SoundFont® audio format, several default modulators are defined. These modulators can be turned off or modified by specifying the same Source, Destination and Transform with zero or non-default Modulation Amount parameters.

The modulator defaults include the standard MIDI controllers such as Pitch Wheel, Vibrato Depth, and Volume, as well as MIDI Velocity control of loudness and Filter Cutoff.

The SoundFont® Audio Format Sample Parameters

Figure 12:
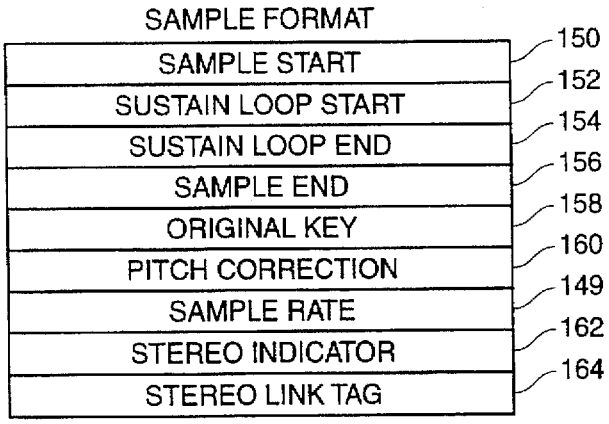
FIG. 12 is a diagram of the audio sample format.

The sample parameters represented in revision 2.0 SoundFont® audio format carry additional information which is not expressly required to reproduce the sound, but is useful in further editing the SoundFont® audio format bank. FIG. 12 is a diagram of the Sample Format. The original sample rate 149 of the sample and pointers to the sample Start 150, Sustain Loop Start 152, Sustain Loop End 154, and sample End 156 data points are contained in the sample parameters. Additionally, the Original Key 158 of the sample is specified in the sample parameters. This indicates the MIDI key number to which this sample naturally corresponds. A null value is allowed for sounds which do not meaningfully correspond to a MIDI key number. Finally, a Pitch Correction 160 is included in the sample parameters to allow for any mistuning that might be inherent in the sample itself. Also, a stereo indicator 162 and link tag 164, discussed below, are included.

SoundFont® Audio Format

The SoundFont® audio format, in a manner analogous to character fonts, enables the portable rendering of a musical composition with the actual timbres intended by the performer or composer. The SoundFont® audio format is a portable, extensible, general interchange standard for wavetable synthesizer sounds and their associated articulation data.

Figure 8:
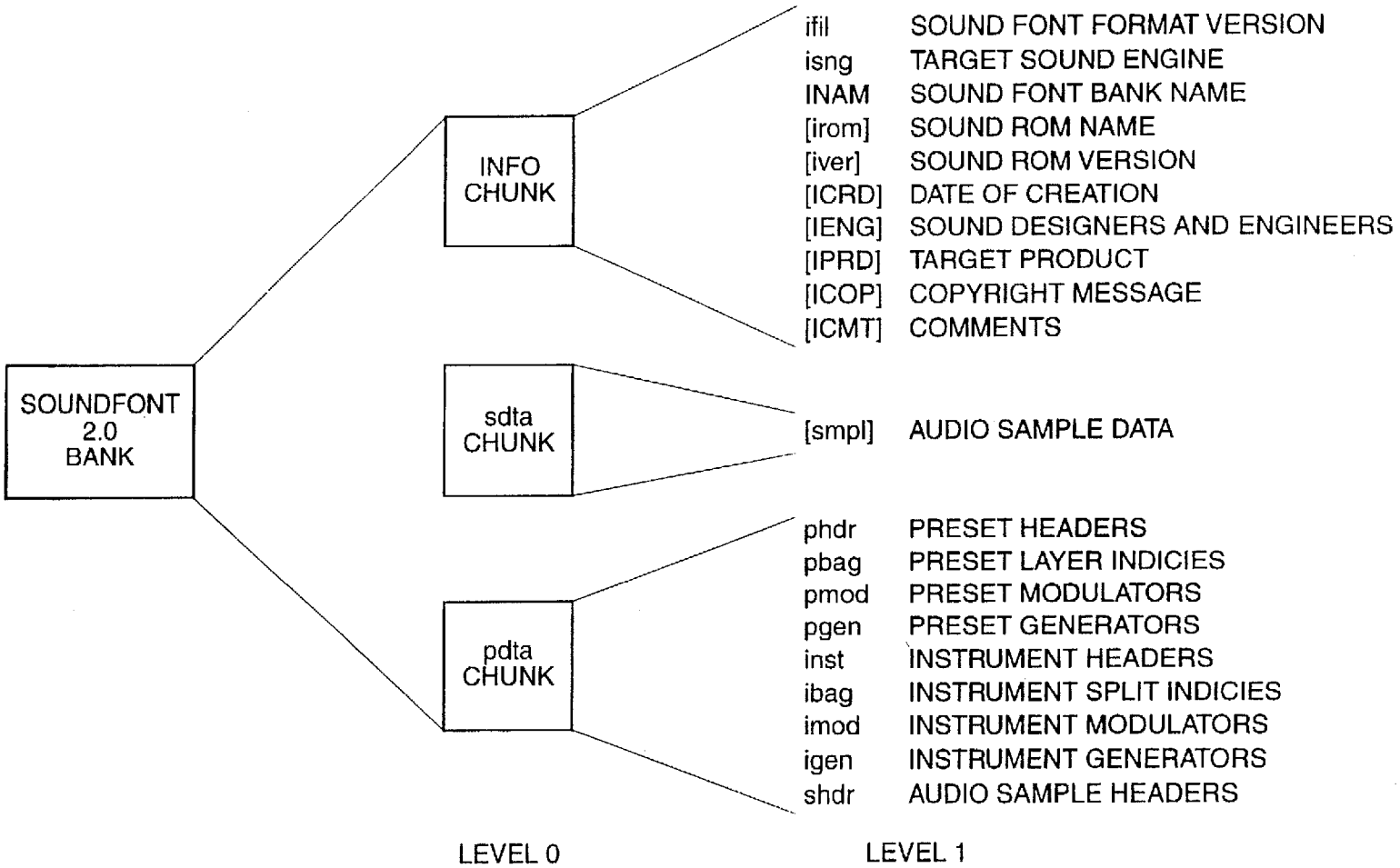
FIG. 8 is a diagram of the RIFF file structure incorporating the present invention.

A SoundFont® audio format bank is a RIFF file containing header information, 16 bit linear sample data, and hierarchically organized articulation information about the MIDI presets contained within the bank. The RIFF file structure is shown in FIG. 8. Parameters are specified on a precisely defined, perceptual relevant basis with adequate resolution to meet the best rendering engines. The structure of the SoundFont® audio format has been carefully designed to allow extension to arbitrarily complex modulation and synthesis networks.

FIG. 9 shows the file format image for the RIFF file structure of FIG. 8. Appendix I sets forth a description of each of the structures of FIG. 9.

Figure 10:
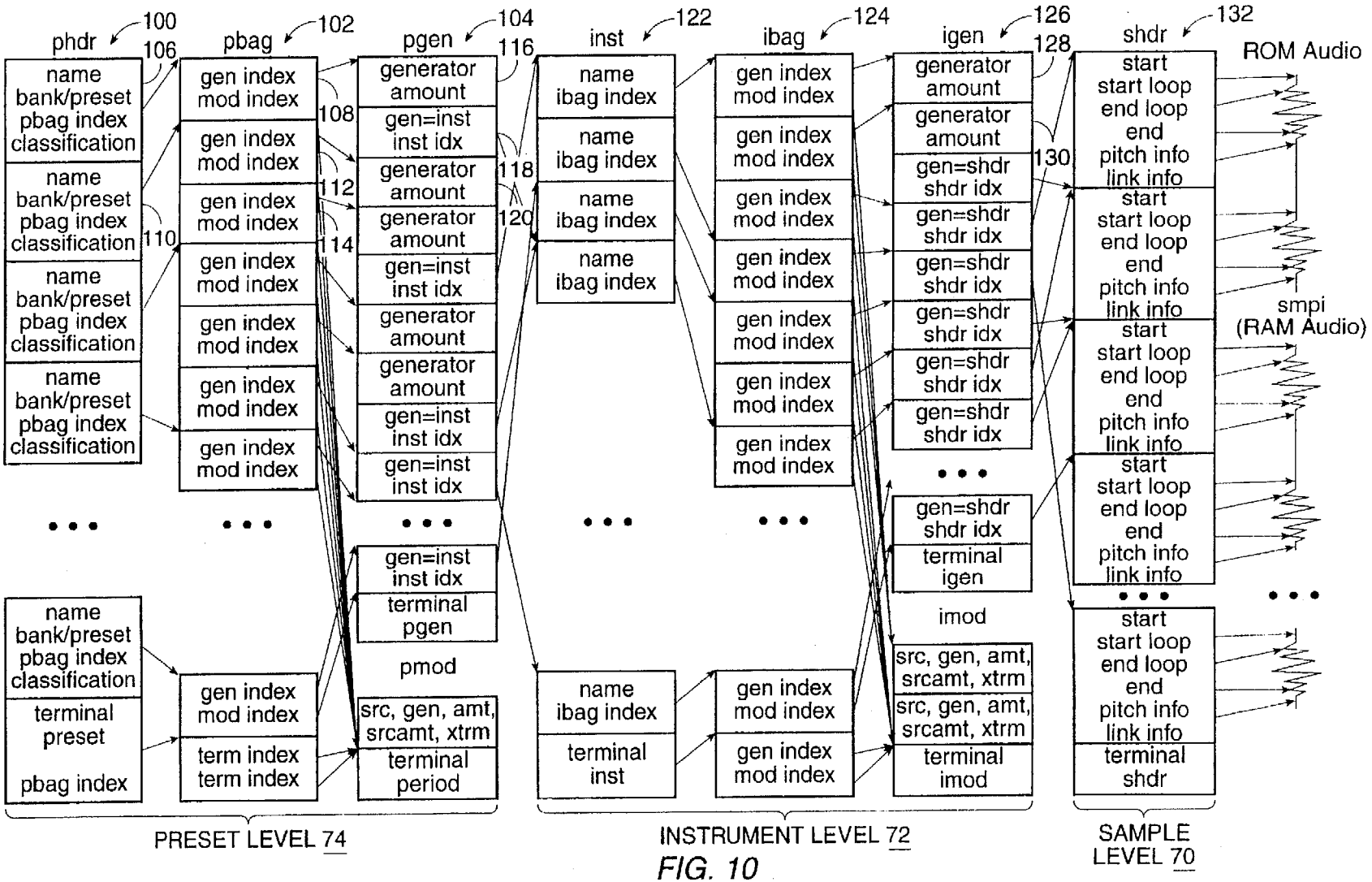
FIG. 10 is a diagram of the articulation data structure according to the present invention.

FIG. 10 illustrates the articulation data structure according to the present invention. Preset level 74 is illustrated as three columns showing the preset headers 100, the preset layer indices 102, and the preset generators and modulators 104. In the example shown, a preset header 106 points to a single generator index and modulator index 108 in preset layer index 102. In another example, a preset header 110 points to two indices 112 and 114. Different preset generators can be used, as illustrated by layer index 108 pointing to a generator and amount 116 and a generator and instrument index 118. Index 112, on the other hand, only points to a generator and amount 120 (a global preset layer).

Instrument level 72 is accessed by the instrument index pointers in preset generators 104. The instrument level includes instrument headers 122 which point to instrument split indices 124. One or more split indices can be assigned to any one instrument header. The instrument split indices, in turn, point to a particular instrument generators 126. The generators can have just a generator and amount (thus being a global split), such as instrument generator 128, or can include a pointer to a sample, such as instrument generator 130. Finally, the instrument generators point to the audio sample headers 132. The audio sample headers provide information about the audio sample and the audio sample itself.

Unit Definitions

There are a variety of specific units cited in this document. Some of these units are conventional within the music and sound industry. Others have been created specifically for the present invention. The units have two basic characteristics. First, all the units are perceptually additive. The primary units used are percentages, decibels (dB) and two newly defined units, absolute cents (as opposed to the well-known musical cents measuring pitch deviation) and time cents.

Second, the units either have an absolute meaning related to a physical phenomena, or a relative meaning related to another unit. Units in the instrument or sample level frequently have absolute meaning, that is they determine an absolute physical value such as Hz. However, in the preset level the same SoundFont® audio format parameter will only have a relative meaning, such as semitones of pitch shift.

Relative Units

Centibels: Centibels (abbreviated Cb) are a relative unit of gain or attenuation, with ten times the sensitivity of decibels (dB). For two amplitudes A and B, the Cb equivalent gain change is:

$$Cb=200 \log 10 (A/B);$$

A negative Cb value indicates A is quieter than B. Note that depending on the definition of signals A and B, a positive number can indicate either gain or attenuation.

Cents: Cents are a relative unit of pitch. A cent is $1/1200$ of an octave. For two frequencies F and G, the cents of pitch change is expressed by:

$$\text{cents}=1200 \log 2 (F/G);$$

A negative number of cents indicates that frequency F is lower than frequency G.

TimeCents: TimeCents are a new defined unit which are a relative unit of duration, that is a relative unit of time. For two time periods T and U, the TimeCents of time change is expressed by:

$$\text{timecents}=1200 \log 2 (T/U);$$

A negative number of timecents indicates that time T is shorter than time U. The similarity of TimeCents to cents is obvious from the formula. TimeCents is a particularly useful unit for expressing envelope and delay times. It is a perceptually relevant unit, which scales with the factor as cents. In particular, if the waveform pitch is varied in cents and the envelope time parameters in TimeCents, the resulting waveform will be invariant in shape to an additive adjustment of a positive offset to pitch and a negative adjustment of the same magnitude to all time parameters.

Percentage: Tenths of percent of Full Scale is another useful relative (and absolute) measure. The Full Scale unit can be dimensionless, or be measured in dB, cents, or timecents. A relative value of zero indicates that there is no change in the effect; a relative value of 1000 indicates the effect has been increased by a full scale amount. A relative value of −1000 indicates the effect has been decreased by a full scale amount.

Absolute Units

All parameters have been specified in a physically meaningful and well-defined manner. In previous formats, including SoundFont® audio format, some of the parameters have been specified in a machine dependent manner. For example, the frequency of a low frequency modulation oscillator (LFO) might have previously been expressed in arbitrary units from 0 to 255. In revision 2.0 SoundFont® audio format, all units are specified in a physically referenced form, so that the LFO's frequency is expressed in cents (a cent is a hundredth of a musical semitone) relative to the frequency of the lowest key on the MIDI keyboard.

When specifying any of these units absolutely, a reference is required.

Centibels: In revision 2.0 SoundFont® audio format, this is generally a "full level" note for centibel units. A value of 0 Cb for a SoundFont® audio format parameter indicates that the note will come out as loud as the instrument designer has designated for a note of "full" loudness.

TimeCents: Absolute timecents are given by the formula:

$$\text{absolute timecents}=1200\log_2(t), \text{ where } t=\text{time in seconds}$$

In revision 2.0 SoundFont® audio format, the TimeCents absolute reference is 1 second. A value of zero represents a 1 second time or 1 second for a full (96 dB) transition.

Absolute Cents: All units of frequency are in "Absolute Cents." Absolute Cents are defined by the MIDI key number scale, with 0 being the absolute frequency of MIDI key number 0, or 8.1758 Hz. Revision 2.0 SoundFont® audio format parameter units have been designed to allow specification equal or beyond the Minimum Perceptible Difference for the parameter. The unit of a "cent" is well known by musicians as 1/100 of a semitone, which is below the Minimum Perceptible Difference of frequency.

Absolute Cents are used not only for pitch, but also for less perceptible frequencies such as Filter Cutoff Frequency. While few synthesis engines would support filters with this accuracy of cutoff, the simplicity of having a single perceptual unit of frequency was chosen as consistent with the revision 2.0 SoundFont® audio format philosophy. Synthesis engines with lower resolutions simply round the specified Filter Cutoff Frequency to their nearest equivalent.

Reproducability of SoundFont® Audio Format

The precise definition of parameters is important so as to provide for reproducability by a variety of platforms. Varying hardware platforms may have differing capabilities, but if the intended parameter definition is known, appropriate translation of parameters to allow the best possible rendition of the SoundFont® audio format on each platform is possible.

For example, consider the definition of Volume Envelope Attack Time. This is defined in revision 2.0 SoundFont® audio format as the time from when the Volume Envelope Delay time expires until the Volume Envelope has reached its peak amplitude. The attack shape is defined as a linear increase in amplitude throughout the attack phase. Thus the behavior of the audio within the attack phase is completely defined.

A particular synthesis engine might be designed without a linear amplitude increase as a physical capability. In particular, some synthesis engines create their envelopes as sequences of constant dB/sec ramps to fixed dB endpoints. Such a synthesis engine would have to simulate a linear attack as a sequence of several of its native ramps. The total elapsed time of these ramps would be set to the attack time, and the relative heights of the ramp endpoints would be set to approximate points on the linear amplitude attack trajectory. Similar techniques can be used to simulate other revision 2.0 SoundFont audio format parameter definitions when so required.

Perceptually Additive Units

All the revision 2.0 SoundFont® audio format units which can be edited are expressed in units that are "perceptually additive." Generally speaking, this means that by adding the same amount to two different values of a given parameter, the perception will be that the change in both cases will be of the same degree. Perceptually additive units are particularly useful because they allow editing or alteration of values in an easy manner.

The property of perceptual additivity can be strictly defined as follows. If the measurement units of a perceivable phenomenon in a particular context are perceptually additive, then for any four measured values W, X, Y, and Z, where W=D+X, and Y=D+Z (D being constant), the perceived difference from X to W will be same as the perceived difference from Z to Y.

For most phenomena which can be perceived over a wide range of values perceptually additive units are typically logarithmic. When a logarithmic scale is used, the following relationships hold:

| Value | Value expressed as power of ten | Log (Value) |
|---|---|---|
| 0.1 | $10^{-1}$ | −1.0 |
| 1 | $10^{0}$ | 0.0 |
| 10 | $10^{1}$ | 1.0 |
| 100 | $10^{2}$ | 2.0 |
| 1000 | $10^{3}$ | 3.0 |

Thus the logarithm of 0.1 is −1, and the logarithm of 100 is 2. As can be seen, adding the same value of, for example, 1 to each log(value) increases the underlying value in each case by ten times.

If we attempt to determine, for example, perceptually additive units of sound intensity, we find that these are logarithmic units. A common logarithmic unit of sound intensity is the decibel (dB). It is defined as ten times the logarithm to the base 10 of the ratio of intensity of two sounds. By defining one sound as a reference, an absolute measure of sound intensity may also be established. It can be experimentally verified that the perceived difference in loudness between a sound at 40 decibels and one at 50 decibels is indeed the same as the perceived difference between a sound at 80 dB and one at 90 dB. This would not be the case if the sound intensity were measured in the CGS physical units of ergs per cubic centimeter.

Another perceptually additive unit is the measurement of pitch in musical cents. This is easily seen by recalling that a musical cent is 1/100 of a semitone, and a semitone is 1/12 of an octave. An octave is, of course, a logarithmic measure of frequency implying a doubling. Musicians will easily recognize that transposing a sequence of notes by a fixed number of cents, semitones, or octaves changes all the pitches by a perceptually identical difference, leaving the melody intact.

One SoundFont® audio format unit which is not strictly logarithmic is the measure of degree of reverberation or chorus processing. The units of these generators are in terms of a percentage of the total amplitude of the sound to be sent to the associated processor. However, it is true that the perceived difference between a sound with 0% reverberation and one with 10% reverberation is the same as the difference between one with 90% reverberation and one with 100% reverberation. The reason for this deviation from strict logarithmic relationship (we might have expected the difference between 1% and 2% to be the same as 50% and 100% had the perceptually additive units been logarithmic) is that we are comparing the degree of reverberation against the full level of the direct or unprocessed sound.

Since time is typically expressed in linear units such as seconds, the present invention provides a new measure of time called "time cents," defined above on a logarithmic scale. When phenomena such as the attack and decay of musical notes are perceived, time is perceptually additive in a logarithmic scale. It can be seen that this corresponds, like intensity and pitch, to a proportionate change in the value. In other words, the perceived difference between 10 milliseconds and 20 milliseconds is the same as that between one second and two seconds; they are both a doubling.

For example, Envelope Decay Time is measured not in seconds or milliseconds, but in timecents. An absolute timecent is defined as 1200 times the base 2 logarithm of the time in seconds. A relative timecent is 1200 times the base 2 logarithm of the ratio of the times.

Specification of Envelope Decay Time in timecents allows additive modification of the decay time. For example, if a particular instrument contained a set of Instrument Splits which spanned Envelope Decay Times of 200 msec at the low end of the keyboard and 20 msec at the high end, a preset could add a relative timecent representing a ratio of 1.5, and produce a preset which gave a decay time of 300 msec at the low end of the keyboard and 30 msec at the high end. Furthermore, when MIDI Key Number is applied to modulate Envelope Decay Time, it is appropriate to scale by an equal ratio per octave, rather than a fixed number of msec per octave. This means that a fixed number of timecents per MIDI Key Number deviation are added to the default decay time in timecents.

The units chosen are all perceptually additive. This means that when a relative layer parameter is added to a variety of underlying split parameter, the resulting parameters are perceptually spaced in the same manner as in the original instrument. For example, if volume envelope attack time were expressed in milliseconds, a typical keyboard might have very quick attack times of 10 msec at the high notes, and slower attack times of 100 msec on the low notes. If the relative layer were also expressed in the perceptually non-additive milliseconds, an additive value of 10 msec would double the attack time for the high notes while changing the low notes by only ten percent. Revision 2.0 SoundFont® audio format solves this particular dilemma by inventing a logarithmic measure of time, dubbed "TimeCents", which is perceptually additive.

Similar units (cents, dB, and percentages) have been used throughout revision 2.0 SoundFont® audio format. By using perceptually additive units, revision 2.0 SoundFont® audio format provides the ability to customize an existing "instrument" by simply adding a relative parameter to that instrument. In the example above, the attack time was extended while still maintaining the characteristic attack time relationship over the keyboard. Any other parameter can be similarly adjusted, thus providing particularly easy and efficient editing of presets.

Pitch of sample

A unique aspect of revision 2.0 SoundFont® audio format is the manner in which the pitch of the sampled data is maintained. In previous formats, two approaches have been taken. In the simplest approach, a single number is maintained which expresses the pitch shift desired at a "root" keyboard key. This single number must be computed from the sample rate of the sample, the output sample rate of the synthesizer, the desired pitch at the root key, and any tuning error in the sample itself.

In other approaches, the sample rate of the sample is maintained as well as any desired pitch correction. When the "root" key is played, the pitch shift is equal to the ratio of the sample rate of the sample to the output sample rate, altered by any correction. Corrections due to sample tuning errors as well as those deliberately required to create a special effect are combined.

Revision 2.0 SoundFont® audio format maintains for each sample not only the sample rate of the sample but also the original key which corresponds to the sound, any tuning correction associated with the sample, and any deliberate tuning change (the deliberate tuning change is maintained at the instrument level). For example, if a 44.1 Khz sample of a piano's middle C was made, the number 60 associated with MIDI middle C would be stored as the "original key" along with 44100. If a sound designer determined that the recording were flat by two cents, a two cent positive pitch correction would also be stored. These three numbers would not be altered even if the placement of the sample in the SoundFont audio format was not such that the keyboard middle C played the sample with no shift in pitch. SoundFont audio format maintains separately a "root" key whose default value is this natural key, but which can be changed to alter the effective placement of the sample on the keyboard, and a coarse and fine tuning to allow deliberate changes in pitch.

The advantage of such a format comes when a SoundFont® audio format is to be edited. In this case, even if the placement of the sample is altered, when the sound designer goes to use the sample in another instrument, the correct sample rate (indicating natural bandwidth), original key (indicating the source of the sound) and pitch correction (so that he need not again determine the exact pitch) are available.

Revision 2.0 SoundFont® audio format provides for an "unpitched" value (conventionally −1) for the original key to be used when the sound does not have a musical pitch.

Stereo Tags

Another unique aspect of revision 2.0 SoundFont® audio format is the way in which stereo samples are handled. Stereo samples are particularly useful when reproducing a musical instrument which has an associated sound field. A piano is a good example. The low notes of a piano appear to come from the left, while the high notes come from the right. The stereo samples also add a spacious feel to the sound which is missing when a single monophonic sample is used.

In previous formats, special provisions are made in the equivalent of the instrument level to accommodate stereo samples. In revision 2.0 SoundFont® audio format, the sample itself is tagged as stereo (indicator 162 in FIG. 12), and has the location of its mate in the same tag (tag 164 in FIG. 12). This means that when editing the SoundFont audio format, a stereo sample can be maintained as stereo without needing to refer to the instrument in which the sample is used.

The format can also be expanded to support even greater degrees of sample associativity. If a sample is simply tagged as "linked", with a pointer to another member of the linked set which are all similarly linked in a circular manner, then triples, quads, or even more samples can be maintained for special handling.

Use of Identical Data to Eliminate Interpolator Incompatibility

Wavetable synthesizers typically shift the pitch of the audio sample data they are playing by a process known as interpolation. This process approximates the value of the original analog audio signal by performing mathematics on some number of known sample data points surrounding the required analog data location.

An inexpensive, yet somewhat flawed method of interpolation is equivalent to drawing a line between the two proximal data points. This method is termed "linear interpolation." A more expensive and audibly superior method instead computes a curved function using N proximal data points, appropriately dubbed N point interpolation.

Because both these methods are commonly in use, any format which purports to be portable among both types of systems must perform adequately in both. While the quality of linear interpolation will limit the ultimate fidelity of systems using this technique, an actual inversion of fidelity occurs if a loop point in a sample is defined and tested strictly using linear interpolation.

Samples are looped to provide for arbitrarily long duration notes. When a loop occurs in a sample, logically the loop end point (170 in FIG. 3) is spliced against the (hopefully equivalent) loop start point (172 in FIG. 3). If such a splice is sufficiently smooth, no loop artifact occurs.

Unfortunately, when interpolation comes into play, more than one sample is involved in the reproduction of the output. With linear interpolation, it is sufficient that the value of the sample data point at the end of the loop be (virtually) identical to the value of the sample data point at the start. However, when the computation of the interpolated audio data extends beyond the proximal two points, data outside the loop boundary begins to affect the sound of the loop. If that data is not supportive of an artifact free loop, clicking and buzzing during loop playback can occur.

The revision 2.0 SoundFont® audio format standard provides a new technique for elimination of such problems. The standard calls for the forcing of the proximal eight points surrounding the loop start and end points to be correspondingly identical. More than eight points are not required; experimentation shows that the artifacts produced by such distant data are inaudible even if used in the interpolation. Forcing the data points to be correspondingly identical guarantees that all interpolators, regardless of order, will produce artifact free loops.

A variety of techniques can be applied to change the audio sample data to conform to the standard. One example is set forth as follows. By their nature, the loop start and end points are in similar time domain waveforms. If a short (5 to 20 millisecond) triangular window with a nine sample flat top is applied to both loops, and the resulting two waveforms are averaged by adding each pair of points and dividing by two, a resulting loop correction signal will be produced. If this signal is now cross-faded into the start and end of the loop, the data will be forced to be identical with virtually no disruption of the original data.

Mathematically stated, if $X_s$ is the sample data point at the start of the loop, $X_e$ is the sample data point at the loop end, and the sample rate is 50 kHz, then we can form the loop correction signal $L_n$:

For n from −253 to −5: $L_n=(254+n)\,(X_{(s+n)}+X_{(e+n)})/500$

For n from −4 to 4: $L_n=(X_{(s+n)}+X_{(e+n)})/2$

For n from 5 to 253: $L_n=(254-n)\,(X_{(s+n)}+X_{(e+n)})/500$

The cross-fade is similarly performed around both loop start and loop end:

For n from −253 to −5: $X'_{(s+n)}=(245+n)\,L_n/250+(-4-n)X_{(s+n)}/250$

For n from −4 to 4: $X'_{(s+n)}=L_n$

For n from 5 to 253: $X'_{(s+n)}=(254-n)\,L_n/250+(-4+n)X_{(s+n)}/250$

For n from −253 to −5: $X'_{(e+n)}=(254+n)\,L_n/250+(-4-n)X_{(e+n)}/250$

For n from −4 to 4: $X'_{(e+n)}=L_n$

For n from 5 to 253: $X'_{(e+n)}=(254-n)\,L_n/250+(-4+n)X_{(e+n)}/250$

It should be clear from the mathematical equations that the functions can be simplified by combining the averaging and cross-fading operations.

As will be understood by those familiar with the art, the present invention may be embodied in other specific forms without departing from the spirit or essential characteristics thereof. For example, other units that are perceptually additive could be used rather than the ones set forth above. For example, time could be expressed as a logarithmic value multiplied by something other than 1200, or could be expressed in percentage form. Accordingly, the foregoing description is intended to be illustrative of the invention, and reference should be made to the following claims for an understanding of the scope of the invention.

What is claimed is:

1. A memory for storing audio sample data for access by a program being executed on a audio data processing system, comprising:

a data format structure stored in said memory, said data format structure including information used by said program and including at least one preset, said preset referencing an instrument, said preset optionally including one or more articulation parameters for specifying aspects of said instrument;

at least one instrument referenced by each of said presets, each said instrument referencing an audio sample and optionally including one or more articulation parameters for specifying aspects of said instrument;

each of said articulation parameters being specified in units related to a physical characteristic of audio which is unrelated to any particular machine for creating or playing audio samples.

2. The memory of claim 1 wherein said units are perceptively additive.

3. The memory of claim 2 wherein said units are specified such that adding the same amount in such units to two different values in such units will proportionately affect the underlying physical values represented by said units, said units including percentages and decibels.

4. The memory of claim 2 wherein one of said units is absolute cents, wherein an absolute cent is defined as 1/100 of a semitone, referenced to a 0 value corresponding to MIDI key number 0, which is assigned to 8.1758 Hz.

5. The memory of claim 4 wherein instrument articulation parameters expressed in absolute cents include:

modulation LFO frequency; and initial filter cutoff.

6. A memory for storing audio sample data for access by a program being executed on a audio data processing system, comprising:

a data format structure stored in said memory, said data format structure including information used by said program and including at least one preset, said preset referencing an instrument, said preset optionally including one or more articulation parameters for specifying aspects of said instrument;

at least one instrument referenced by each of said presets, each said instrument referencing an audio sample and optionally including one or more articulation parameters for specifying aspects of said, instrument;

each of said articulation parameters being specified in units related to a physical characteristic of audio which is unrelated to any particular machine for creating or playing audio samples;

wherein said units are perceptively additive; and wherein one of said units is a relative time expressed in time cents, wherein time cents is defined for two periods of time T and U to be equal to 1200 $\log_2$ (T/U).

7. The memory of claim 6 wherein instrument articulation parameters expressed in relative time cents include:

modulation LFO delay;

vibrato LFO delay;

modulation envelope delay time;

modulation envelope attack time;

volume envelope attack time;

modulation envelope hold time;

volume envelope hold time;

modulation envelope decay time;

modulation envelope release time; and volume envelope release time.

8. A memory for storing audio sample data for access by a program being executed on a audio data processing system, comprising:

a data format structure stored in said memory, said data format structure including information used by said program and including at least one preset, said preset referencing an instrument, said preset optionally including one or more articulation parameters for specifying aspects of said instrument;

at least one instrument referenced by each of said presets, each said instrument referencing an audio sample and optionally including one or more articulation parameters for specifying aspects of said instrument;

each of said articulation parameters being specified in units related to a physical characteristic of audio which is unrelated to any particular machine for creating or playing audio samples; and wherein one of said units is an absolute time expressed in time cents, wherein time cents is defined for a time T in seconds to be equal to 1200 $\log_2$ (T).

9. The memory of claim 1 wherein instrument articulation parameters expressed in absolute time cents include:

modulation LFO delay;

vibrato LFO delay;

modulation envelope delay time;

modulation envelope attack time;

volume envelope attack time;

modulation envelope hold time;

volume envelope hold time;

modulation envelope decay time;

modulation envelope release time; and volume envelope release time.

10. The memory of claim 1 wherein one or more of said audio samples comprise a block of data comprising:

one or more data segments of digitized audio;

a sample rate associated with each of said digitized audio segments;

an original key associated with each of said digitized audio segments; and a pitch correction associated with said original key.

11. The memory of claim 1 wherein said articulation parameters comprise generators and modulators, at least one of said modulators comprising:

a first source enumerator specifying a first source of realtime information associated with said one modulator;

a generator enumerator specifying a one of said generators associated with said one modulator;

an amount specifying a degree said first source enumerator affects said one generator;

a second source enumerator specifying a second source of realtime information for varying said degree said first source enumerator affects said one generator; and a transform enumerator specifying a transformation operation on said first source.

12. The memory of claim 1 wherein said audio samples include stereo audio samples, each of said stereo audio samples being a block of data including a pointer to a second block of data containing a mate stereo audio sample.

13. A memory for storing audio sample data for access by a program being executed on a audio data processing system, comprising:

a data format structure stored in said memory, said data format structure including information used by said program and including a plurality of presets, each of said presets referencing an instrument, at least some of said presets including articulation parameters for specifying aspects of said instrument;

at least one instrument referenced by each of said presets, each of said instruments referencing an audio sample and including articulation parameters for specifying aspects of said instrument;

each of said articulation parameters being specified in units related to a physical characteristic of audio which is unrelated to any particular machine for creating or playing audio samples, said units being perceptively additive;

a plurality of said audio samples comprising a block of data including one or more data segments of digitized audio, a sample rate associated with each of said digitized audio segments, an original key associated with each of said digitized audio segments, and a pitch correction associated with said original key;

said articulation parameters comprising generators and modulators, at least one of said modulators including a first source enumerator specifying a first source of real time information associated with said one modulator, a generator enumerator specifying a one of said generators associated with said one modulator, an amount specifying a degree said first source enumerator affects said one generator, a second source enumerator specifying a second source of real time information for varying said degree said first source enumerator affects said one generator, and a transform enumerator specifying a transformation operation on said first source.

14. The memory of claim 13 wherein said audio samples include stereo audio samples, each of said stereo audio samples being a block of data including a pointer to a second block of data containing a mate stereo audio sample.

15. An audio data processing system comprising:

a processor for processing audio sample data;

a memory for storing audio sample data for access by a program being executed on said processor, including:

a data format structure stored in said memory, said data format structure including information used by said program and including at least one preset, each preset referencing at least one instrument, said presets optionally including one or more articulation parameters for specifying aspects of said instrument;

at least one instrument referenced by each of said presets, each of said instruments referencing an audio sample and optionally including one or more articulation parameters for specifying aspects of said instrument;

each of said articulation parameters being specified in units related to a physical characteristic of audio which is unrelated to any particular machine for creating or playing audio samples.

16. The system of claim 15 wherein said units are perceptively additive.

17. The system of claim 16 wherein said units are specified such that adding the same amount in such units to two different values in such units will proportionately affect the underlying physical values represented by said units, said units including percentages and decibels.

18. An audio data processing system comprising:

a processor for processing audio sample data;

a memory for storing audio sample data for access by a program being executed on said processor, including:

a data format structure stored in said memory, said data format structure including information used by said program and including at least one preset, each preset referencing at least one instrument, said presets optionally including one or more articulation parameters for specifying aspects of said instrument;

at least one instrument referenced by each of said presets, each of said instruments referencing an audio sample and optionally including one or more articulation parameters for specifying aspects of said instrument;

each of said articulation parameters being specified in units related to a physical characteristic of audio which is unrelated to any particular machine for creating or playing audio samples;

wherein said units are perceptively additive; and wherein one of said units is absolute cents, wherein an absolute cent is defined as 1/100 of a semitone, referenced to a 0 value corresponding to MIDI key number 0, which is assigned to 8.1758 Hz.

19. The system of claim 18 wherein instrument articulation parameters expressed in absolute cents include:

modulation LFO frequency; and initial filter cutoff.

20. An audio data processing system comprising:

a processor for processing audio sample data;

a memory for storing audio sample data for access by a program being executed on said processor, including:

a data format structure stored in said memory, said data format structure including information used by said program and including at least one preset, each preset referencing at least one instrument, said presets optionally including one or more articulation parameters for specifying aspects of said instrument;

at least one instrument referenced by each of said presets, each of said instruments referencing an audio sample and optionally including one or more articulation parameters for specifying aspects of said instrument;

each of said articulation parameters being specified in units related to a physical characteristic of audio which is unrelated to any particular machine for creating or playing audio samples;

wherein said units are perceptively additive; and wherein one of said units is a relative time expressed in time cents, wherein time cents is defined for two periods of time T and U to be equal to 1200 $\log_2$ (T/U).

21. The system of claim 20 wherein preset articulation parameters expressed in time cents include:

modulation LFO delay;

vibrato LFO delay;

modulation envelope delay time;

modulation envelope attack time;

volume envelope attack time;

modulation envelope hold time;

volume envelope hold time;

modulation envelope decay time;

modulation envelope release time; and volume envelope release time.

22. An audio data processing system comprising:

a processor for processing audio sample data;

a memory for storing audio sample data for access bv a program being executed on said processor, including:

a data format structure stored in said memory, said data format structure including information used by said program and including at least one preset, each preset referencing at least one instrument, said presets optionally including one or more articulation parameters for specifying aspects of said instrument;

at least one instrument referenced by each of said presets, each of said instruments referencing an audio sample and optionally including one or more articulation parameters for specifying aspects of said instrument;

each of said articulation parameters being specified in units related to a physical characteristic of audio which is unrelated to any particular machine for creating or playing audio samples;

wherein said units are perceptively additive; and wherein one of said units is an absolute time expressed in time cents, wherein time cents is defined for a time T in seconds to be equal to 1200 $\log_2$ (T).

23. The system of claim 22 wherein instrument articulation parameters expressed in absolute time cents include:

modulation LFO delay;

vibrato LFO delay;

modulation envelope delay time;

modulation envelope attack time;

volume envelope attack time;

modulation envelope hold time;

volume envelope hold time;

modulation envelope decay time;

modulation envelope release time; and volume envelope release time.

24. The system of claim 15 wherein a plurality of said audio samples comprise a block of data comprising:

one or more segments of digitized audio;

a sample rate associated with each of said digitized audio segments;

an original key associated with each of said digitized audio segments; and a pitch correction associated with said original key.

25. The system of claim 15 wherein said articulation parameters comprise generators and modulators, at least one of said modulators comprising:

a first source enumerator specifying a first source of realtime information associated with said one modulator;

a generator enumerator specifying a one of said generators associated with said one modulator;

an amount specifying a degree said first source enumerator affects said one generator;

a second source enumerator specifying a second source of realtime information for varying said degree said first source enumerator affects said one generator; and a transform enumerator specifying a transformation operation on said first source.

26. The system of claim 15 wherein said audio samples include stereo audio samples, each of said stereo audio samples being a block of data including a pointer to a second block of data containing a mate stereo audio sample.

27. An audio data processing system comprising:

a processor for processing audio sample data;

a memory for storing audio sample data for access by a program being executed on said processor, including:

a data format structure stored in said memory, said data format structure including information used by said program and including a plurality of presets, each of said presets referencing an instrument, at least some of said presets including articulation parameters for specifying aspects of said instrument;

at least one instrument referenced by each of said presets, each of said instruments referencing an audio sample and including articulation parameters for specifying aspects of said instrument;

each of said articulation parameters being specified in units related to a physical characteristic of audio which is unrelated to any particular machine for creating or playing audio samples, said units being perceptively additive;

a plurality of said audio samples comprising a block of data including one or more data segments of digitized audio, a sample rate associated with each of said digitized audio segments, an original key associated with each of said digitized audio segments, and a pitch correction associated with said original key;

said articulation parameters comprising generators and modulators, at least one of said modulators including a first source enumerator specifying a first source of real time information associated with said one modulator, a generator enumerator specifying a one of said generators associated with said one modulator, an amount specifying a degree said first source enumerator affects said one generator, a second source enumerator specifying a second source of real time information for varying said degree said first source enumerator affects said one generator, and a transform enumerator specifying a transformation operation on said first source.

28. A method for storing music sample data for access by a program being executed on a audio data processing system, comprising the steps of:

storing a data format structure in said memory, said data format structure including information used by said program and including at least one preset, said preset referencing an instrument, said preset optionally including one or more articulation parameters for specifying aspects of said instrument;

at least one instrument referenced by each of said presets, each said instrument referencing an audio sample and optionally including one or more articulation parameters for specifying aspects of said instrument;

each of said articulation parameters being specified in units related to a physical characteristic of audio which is unrelated to any particular machine for creating or playing audio samples.

29. The method of claim 28 further comprising the step of specifying said units to be perceptively additive.

30. The method of claim 28 further comprising the steps of storing a plurality of said audio samples as a block of data comprising:

one or more data segments of digitized audio;

a sample rate associated with each of said digitized audio segments;

an original key associated with each of said digitized audio segments; and a pitch correction associated with said original key.

31. The method of claim 28 wherein said articulation parameters comprise generators and modulators, at least one of said modulators comprising:

a first source enumerator specifying a first source of realtime information associated with said one modulator;

a generator specifying a one of said generators associated with said one modulator;

an amount specifying a degree said first source enumerator affects said one generator;

a second source enumerator specifying a second source of realtime information for varying said degree said first source enumerator affects said one generator; and a transform enumerator specifying a transformation operation on said first source.

32. The method of claim 28 wherein said audio samples include stereo audio samples, each of said stereo audio samples being a block of data including a pointer to a second block of data containing a mate stereo audio sample.

33. A method for storing music sample data for access bv a program being executed on a audio data processing system, comprising the steps of:

storing a data format structure in said memory, said data format structure including information used by said program and including at least one preset, said preset referencing an instrument, said preset optionally including one or more articulation parameters for specifying aspects of said instrument;

at least one instrument referenced by each of said presets, each said instrument referencing an audio sample and optionally including one or more articulation parameters for specifying aspects of said instrument;

each of said articulation parameters being specified in units related to a physical characteristic of audio which is unrelated to any particular machine for creating or playing audio samples; and wherein at least one of said audio samples includes a loop start point and a loop end point, and further comprising the step of forcing proximal data points surrounding said loop start point and said loop end point to be substantially identical.

34. The method of claim 33 wherein the number of said substantially identical proximal data points is eight or less.

35. A memory for storing audio sample data for access by a program being executed on a audio data processing system, comprising:

a data format structure stored in said memory, said data format structure including information used by said program and including at least one preset, said preset referencing an instrument, said preset optionally including one or more articulation parameters for specifying aspects of said instrument;

at least one instrument referenced by each of said presets, each said instrument referencing an audio sample and optionally including one or more articulation parameters for specifying aspects of said instrument;

each of said articulation parameters being specified in units related to a physical characteristic of audio which is unrelated to any particular machine for creating or playing audio samples; and wherein at least one of said audio samples includes a loop start point and a loop end point, and wherein proximal data points surrounding said loop start point and said loop end point are set to be substantially identical.

36. The memory of claim 35 wherein the number of said substantially identical proximal data points is eight or less.

* * * * *